United States Patent [19]

Haq

[11] Patent Number: 4,469,723

[45] Date of Patent: Sep. 4, 1984

[54] PLATING CONTROL SYSTEM

[75] Inventor: Nadeemul Haq, Santa Clara, Calif.

[73] Assignee: National Semiconductor Corporation, Santa Clara, Calif.

[21] Appl. No.: 438,107

[22] Filed: Nov. 1, 1982

[51] Int. Cl.[3] ..... B05D 1/26

[52] U.S. Cl. ..... 427/437; 118/686; 118/673; 118/698; 427/430.1

[58] Field of Search ..... 118/686, 687, 669, 673, 118/680, 697, 698; 427/437, 430.1

[56] References Cited

U.S. PATENT DOCUMENTS 4,357,900 11/1982 Buschor ..... 118/697
4,364,977 12/1982 Bernardi ..... 427/429

FOREIGN PATENT DOCUMENTS 2915908 10/1979 Fed. Rep. of Germany ..... 118/697

*Primary Examiner*—Shrive P. Beck
*Attorney, Agent, or Firm*—Paul J. Winters; Michael J. Pollock; Gail W. Woodward

[57] ABSTRACT

An improved method to calculate the relative position between a plating head and an intermittently moved web of material that is to be plated wherein a nozzle directs pressurized fluid through an aperture in the web and the back pressure is monitored as an indication of the relative position of the nozzle and the aperture. Back pressure is represented digitally and a microprocessor waits an interval for the pressure to stabilize, compares the digital signal to a look up table in memory to determine the error in position, and commands movement of the plating head a distance sufficient to bring the error to zero.

4 Claims, 4 Drawing Figures

FIG. 1
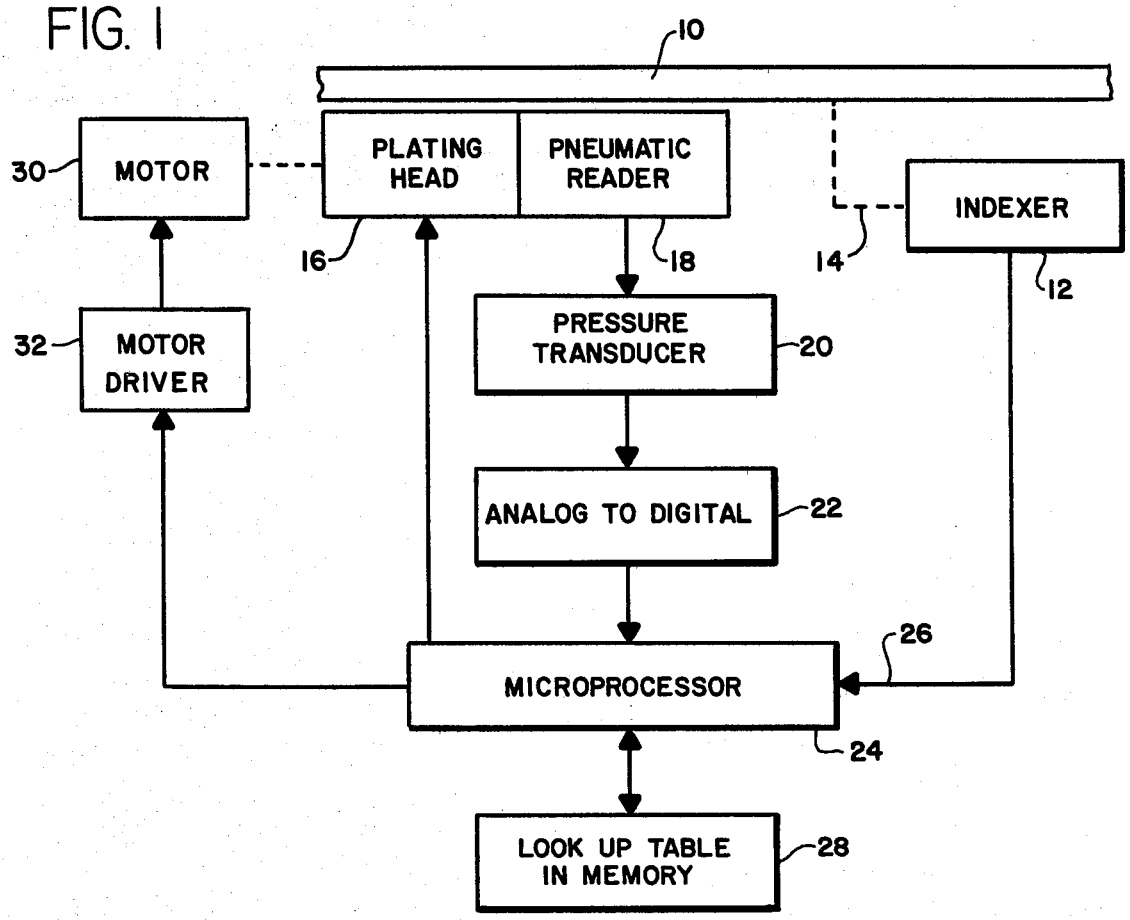
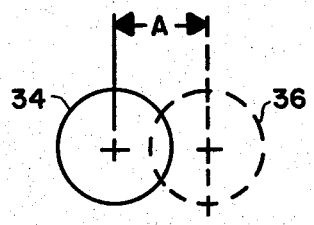
FIG. 2A
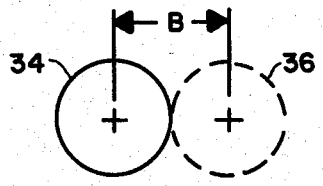
FIG. 2B
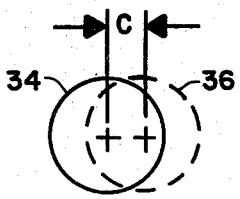
FIG. 2C

PLATING CONTROL SYSTEM

BACKGROUND OF THE INVENTION

This invention comprises an improvement to the invention disclosed in U.S. patent application Ser. No. 06/280,597 by Carl E. Bernardi and titled "Automatic Self-Adjusting Processing Apparatus" and assigned to the assignee of this application now U.S. Pat. No. 4,364,977. The subject matter of this previous patent is specifically incorporated herein by reference and the reader is encouraged to review the Bernardi patent so as to fully understand the principles of the instant invention.

In brief, Bernardi discloses a system for the high speed spot plating of metal onto a web of material that moves intermittently through a plating head. Each time the web stops, the plating head closes about the web, clamping and sealing the web. Plating electrolyte is then directed through passageways in the head into contact with the spots on the web to be plated.

If the spots of plating are to be positioned in the exact right locations, it is necessary to accurately control the relative positions of the plating head and the web. The Bernardi patent teaches a way to do this by directing a stream of fluid from a nozzle through a hole positioned at a known location in the web. Misalignments of the hole and nozzle change the back pressure in the nozzle. The back pressure is measured and represented by an electronic digital signal. Deviations from the desired back pressure cause motors to move the plating head so as to establish a predetermined back pressure and hence the correct relative position.

Although a fluid pressure sensor is the only practical sensing system for reliable operation in the chemical environment of a plating chamber, it does present problems in that fluid pressures are slow to change relative to electronic systems and these delays can slow the entire plating process. The present invention overcomes such problems by introducing a novel method of control and calculation that efficiently copes with the fluctuating pressure inherent in the fluid pressure sensor.

SUMMARY OF THE INVENTION

The present control system, instead of moving the plating head in the correct direction to change the measured back pressure toward the desired value, first determines the back pressure and looks up in memory what such a pressure means in terms of the error in position between the nozzle and the aperture. Then the system, which is based on a microprocessor, commands motors to move the plating heads, all in one movement, the specific distance needed to achieve correct alignment. In this way, there is no chance of the fast electronic control circuits outrunning the slower fluid pressure sensor, and thus overshooting the correct alignment, which could lead to a situation of hunting back and forth for the correct alignment. The following detailed description describes additional advantages and benefits of this improved control system.

BRIEF DESCRIPTION OF THE DRAWING

FIG. 1 is a schematic diagram of the main elements in the control system.

FIGS. 2A, 2B, and 2C schematically show various different relative positions of the nozzle and hole so as to explain the specific correction movements.

DESCRIPTION OF THE PREFERRED EMBODIMENT

A web 10, diagramed in FIG. 1, is moved by a conventional indexer 12 through a mechanical connection 14. The movement is intermittent. When the web of material 10 comes to a stop, a plating head 16 moves into sealing engagement with web 10 so as to convey electrolyte plating fluid to the surface of web 10. The relative position of head 16 and web 10 is measured with precision by a pneumatic reader 18 that comprises the nozzle and back pressure sensing equipment disclosed in the Bernardi U.S. Pat. No. 4,364,977 mentioned earlier. The magnitude of the back pressure is converted into an electronic signal by a transducer 20. This electronic signal is then converted to a digital electronic signal by an analog to digital converter 22.

A microprocessor 24 is programmed to execute the following steps in the present inventive method. When the indexer 12 completes the movement of web 10, that fact is signaled by conventional means over a line 26 to processor 24. The first step is to wait a predetermined interval of time to be sure the back pressure has stabilized. After this interval, the processor enters the digital signal from converter 22. To guard against the possibility of transient errors, the preferred embodiment may take several pressure readings in a row and average them. The next step is for processor 24 to compare the pressure reading to a look up table 28 so as to determine what the measured pressure corresponds to in terms of misalignment distance. This information is then used to generate a command to move head 16 the correct specific distance to position it correctly relative to web 10. A conventional stepping motor 30, controlled by suitable driver circuits 32, may be used for this purpose.

Several different command possibilities may be examined with reference to FIGS. 2A, 2B, and 2C. FIG. 2A diagrams the relative position of a hole 34, in web 10, and a nozzle orifice 36, in reader 18, when the head 16 is correctly positioned relative to web 10. The center-to-center distance A is 40 mils in the preferred embodiment so that a partial overlap of the two circular apertures exists. Consequently, the pressurized fluid stream from nozzle 36 partly escapes through hole 34, thus, lowering the back pressure to an intermediate known target value. When processor 24 receives a digital signal corresponding to this target value, it commands no lateral movement of head 16 at all, but rather just closes the head 16 on web 10, to start the plating action, by mechanisms not disclosed in this specification.

If nozzle 36 is to the right of the desired position, the overlap decreases, and the back pressure increases. This increasing pressure is digitized at selected intervals by converter 22. Each digital pressure has a corresponding correction stored in memory 28 that will move head 16 in one step to the position of FIG. 2A. If head 16 were simply caused to move in the correct direction to bring the back pressure to the target value, it is possible that the high speed processor 24 and motor 30 would move head 16 right through and beyond the proper position before the back pressure applied to transducer 20 could fully adjust to the changing conditions. Hence, this invention moves head 16 both the correct direction and the correct distance.

It is possible that the motor caused movement could itself affect the position of web 10. To deal with this possibility, and to improve accuracy, the above described steps may be repeated one or more times, again waiting a short time for the pressure to stabilize, taking and averaging several pressure measurements, looking up the required movement to position the head correctly, and commanding that movement.

If nozzle 36 is so far to the right as to reach the position in FIG. 2B, or even farther, the back pressure will have reached a maximum unchanging value. Such a condition occurs in the preferred embodiment when dimension B equals or exceeds 60 mils. The instructions stored in memory 28 for this maximum pressure are to move head 16 to the left by 20 mils. This instruction will be repeated at each cycle of the machine until nozzle 36 once again overlaps aperture 34 causing a movement by the correct distance.

If nozzle 36 is left of the correct location, as in FIG. 2C, so that dimension C is between 0 and 40 mils, a correction to the right by the exact correct amount is commanded. The back pressure is, of course, at a minimum when nozzle 36 aligns perfectly with hole 34 and C becomes zero. Any further displacement to the left of nozzle 36 would increase the back pressure to values normally associated with corrections of shorter distance than needed to return to the correct location of FIG. 2A. But this problem can be corrected by the repetition of the correction cycle that takes place after each pressure stabilization waiting interval. Thus, when nozzle 36 is to the left of hole 34, it will be moved to the right by a specified distance, which will bring it somewhere in the range shown in FIG. 2C. Then after an interval, another average pressure will be calculated and used to generate a command to move to the position of FIG. 2A.

Additional programming may be incorporated to refine the operation further. For example, a test could be programmed in to detect when the error is enlarged from one cycle to the next so as to identify corrections in the wrong direction. Such wrong corrections could result if the initial position established by indexer 12 was displaced beyond the set of values stored in memory 28. Another variation to the control method would be to utilize an initialization program that would command a series of trial movements by the motor 30 and record the actual resulting change in position, as measured by the change in back pressure. A trial movement in one direction followed by a trial movement in the opposite direction will yield a discrepancy corresponding to the mechanical slack inherent in the system from linkage tolerances and gear backlash. The measured discrepancy may be stored in memory and compensated for during regular operation.

I claim:

1. A method of positioning a plating head relative to a web of material to be plated in which a stream of fluid is directed against an aperture in the web, and the back pressure in said stream is measured as an indication of the relative alignment between the stream and the aperture, and in which the plating head is adjustable so as to cause the back pressure to be a predetermined amount, comprising the steps of:

A. intermittently moving the web relative to said head;

B. waiting an interval of time after the web has stopped moving relative to the head so as to allow the back pressure to stabilize;

C. measuring the back pressure and converting the measurement to a digital signal representative of the pressure;

D. comparing said digital signal to a table in memory to determine the error in position; and E. moving the plating head in a single movement by an amount sufficient to correct said error in position.

2. The method of claim 1 in which said measuring step comprises taking a plurality of measurements of the back pressure and calculating the average value thereof.

3. The method of claim 1 in which said table in memory stores a series of precalculated non-linear values for the error in position as a function of the back pressure.

4. The method of claim 2 in which said table in memory stores a series of precalculated non-linear values for the error in position as a function of the back pressure.

* * * * *